US006729586B2

(12) United States Patent
Arguijo et al.

(10) Patent No.: US 6,729,586 B2
(45) Date of Patent: May 4, 2004

(54) SYSTEM AND METHOD FOR A DRYER ROUGH-IN BOX WITH CONTOURED VENT RECEPTACLE AND FORMED GROMMET

(76) Inventors: Ralph L. Arguijo, P.O. Box 568, Mesa, AZ (US) 85211-0568; Ivan H. Jack, 1611 E. Fremont Rd., Phoenix, AZ (US) 85042-5777

( * ) Notice: Subject to any disclaimer, the term of this patent is extended or adjusted under 35 U.S.C. 154(b) by 0 days.

(21) Appl. No.: 10/355,576

(22) Filed: Jan. 31, 2003

(65) Prior Publication Data

US 2004/0065786 A1 Apr. 8, 2004

Related U.S. Application Data

(60) Provisional application No. 60/354,364, filed on Feb. 4, 2002, and provisional application No. 60/414,224, filed on Sep. 27, 2002.

(51) Int. Cl.[7] ..... F16L 3/08; F26B 25/06; H02G 3/08

(52) U.S. Cl. ..... 248/65; 34/140; 34/235; 220/3.3

(58) Field of Search ..... 248/65, 75; 34/417, 34/87, 140, 134, 235; 220/3.3

(56) References Cited

U.S. PATENT DOCUMENTS

| | | | | | |
|---|---|---|---|---|---|
| 4,890,396 | A | * | 1/1990 | King | 34/235 |
| 5,476,183 | A | * | 12/1995 | Harpenau | 220/3.3 |
| 5,584,129 | A | * | 12/1996 | Williamson | 34/235 |
| 5,819,435 | A | * | 10/1998 | Tuggle | 34/235 |
| 5,970,623 | A | * | 10/1999 | Tuggle | 34/134 |
| 6,230,418 | B1 | * | 5/2001 | Gomulinski | 34/140 |
| 6,370,794 | B1 | * | 4/2002 | Tuggle | 34/235 |
| 6,584,702 | B2 | * | 7/2003 | Irey | 34/417 |

* cited by examiner

*Primary Examiner*—Anita King
(74) *Attorney, Agent, or Firm*—Snell & Wilmer LLP; Patrick L. Mixon

(57) ABSTRACT

A system for holding a portion of the flexible exhaust hose from a dryer within a wall, thereby allowing the dryer to be placed in close proximity to the wall is provided. The system provides a dryer rough-in box including a contoured surface for smoothly guiding the flexible exhaust hose to minimize bending and kinking. An integral segment of duct is provided to allow for convenient and aesthetic installation, where the connection of the system to the duct in the was is hidden within the wall. Additionally, the rough-in box includes an opening structured and arranged to snugly fit a gas line is provided, thereby aiding in.

16 Claims, 6 Drawing Sheets

SYSTEM AND METHOD FOR A DRYER ROUGH-IN BOX WITH CONTOURED VENT RECEPTACLE AND FORMED GROMMET

This application claims priority of provisional applications; Provisional Application No. 60/354,364; Filed: Feb. 4, 2002 and Provisional Application No. 60/414,224; Filed: Sep. 27, 2002.

BACKGROUND

This invention relates to providing a system and method for recessed dryer rough-in box with contoured vent receptacle and grommet that allows installation of a clothes dyer in a closer proximity to a wall.

Typically, a connection is made from the dryer to a flexible exhaust hose. The other end of the flexible exhaust hose is then connected to a duct inlet protruding from a wall adjacent the dryer. It is often desirable to place the clothes dryer as close to the wall as possible in order to save space, prevent materials from falling behind the clothes dryer, and for aesthetics, etc. The flexible exhaust hose allows movement of the dryer as for cleaning, repair, etc., without the inconvenience of disconnecting it from the exhaust duct. Since the duct inlet commonly protrudes several inches from the wall, the dryer is limited in how close it can be set against the wall by the space required for the flexible exhaust hose and duct inlet. Moving the clothes dryer in a close proximity to the wall may result in kinking and/or crushing the flexible hose, reducing the efficacy of the exhaust vent, thereby diminishing the efficiency of the clothes dryer.

Although solutions to this problem have been sought, they are unsuitable and far from optimal. In most conventional clothes dryer rough-in boxes, the recessed receptacles for accepting the dryer hose and vent are typically rectangular in shape including edges which impede the Venting of the dryer exhaust by kinking the dryer hose when the dryer is pushed against the receptacle. One such conventional method is disclosed in U.S. Pat. No. 5,476,183, issued Dec. 19, 1995 to Harpenau. The Harpenau dryer rough-in box includes planar surfaces including a top, bottom, a pair of sides and a back. The Harpenau dryer rough-in box may be used to permit a dryer to be pushed in close proximity to a wall, while providing a recessed cavity for minimizing kinking of an attached dryer hose. However, as can be seen, the bottom surface is horizontally positioned, and is further perpendicular to the pair of sides. The sides of the box are also parallel to each other so that the box forms a substantially rectangular open structure with a planar back surface. As such, the bottom corners of the box presents spaces wherein the dryer hose may be trapped, and therefore kinked. The Harpenau rough-in box, as those like it, is deficient in that installing a recessed receptacle with a planar bottom surface can result in kinking of the flexible exhaust hose when the hose gets pushed back into the receptacle. For example, the horizontal bottom edge, or a bottom corner of the receptacle, may "catch" the flexible hose, thereby preventing the hose from recoiling smoothly. This, in turn, has deleterious effects, as mentioned above.

One method which attempts to address the kinking problem encountered in the Harpenau patent is currently being sold by In-O-Vate Technologies, 810 Saturn Street, #22, Juniper, Fla. 33477, as disclosed on the world wide web at www.dryerbox.com. The In-O-Vate dryer rough-in box is of substantially similar shape as the Harpenau patent in that the invention includes a top, bottom, and pair of side surfaces which are planar. The pair of substantially parallel sides taper from the front of the box to the rear of the box. The back surface of the rough-in box is of a shorter length than the length of the pair of sides, and of a shorter width than the box front opening. The planar bottom surface of the box is formed from the planar back of the box to the front of the box, and is joined to the pair of sides, such that the bottom planar surface slants downwardly from back to front. An obtuse angle is formed at the intersection of the planar back surface and the planar bottom surface, such that a corner is drawn between the pair of sides along the vertex of the obtuse angle. As such, although the In-O-Vate dryer rough-in box provides a slanted surface for guiding the compression of a retracting flexible dryer hose, the box is still deficient in that the dryer hose may still get trapped in the vertex/corner, thereby reducing the free flow of the dryer exhaust.

Also, since many existing homes have exhaust ducts that protrude from a wall, it is beneficial to have a system that can be easily retrofitted. Installing a system that requires adapting an existing duct through an opening in a receptacle is problematic. It can be more difficult and less aesthetically pleasing than making a connection that is hidden within the wall. Also, the junction between the receptacle and the duct may not conveniently achieve a tight seal, which is desirable for insulation, pest control and aesthetic reasons, etc. Additionally, there may not be enough existing duct within the wall to install the receptacle at the desired height, requiring installation of a separate piece of duct—an additional step that adds inconvenience. Finally, for installation of gas-powered dryers, it is desirable to route the gas line through the receptacle. Receptacles with generic-sized openings may fail to achieve a tight fit between the gas line and the receptacle, which is desirable for insulation, pest control and aesthetic reasons, etc.

OBJECTS OF THE INVENTION

A primary object and feature of the present invention is to provide a holding system that stores at least a portion of the flexible exhaust hose from a dryer within a wall. It is a further object and feature of the present invention to provide such a system that guides the flexible exhaust hose from a dryer to the duct connection, when the dryer is placed in close proximity to the wall, thereby reducing kinking.

It is a further object and feature of the present invention to provide an exhaust duct-extension, which allows the system to be installed more conveniently than the prior art.

It is a further object and feature of the present invention to provide a grommet specifically designed to snugly fit a gas conduit, which allows the system to be installed more conveniently than the prior art.

It is a further object and feature of the present invention to provide an exhaust duct-extension, which allows convenient to installation through an exterior wall A further primary object and feature of the invention is to provide such a system, which is efficient, inexpensive, and handy. Other objects and features of this invention will become apparent with reference to the following descriptions.

SUMMARY OF THE INVENTION

In accordance with a preferred embodiment hereof, this invention provides a dryer rough-in box system located essentially within a wall having at least one stud, for providing for holding at least a portion of a flexible exhaust hose within the wall. As used herein, "holding system" and "rough-in box system" may be used interchangeably. In accordance with the present invention, the holding system comprises, in combination: a guiding means for smoothly guiding at least a portion of the flexible exhaust hose into said holding system; and at least one attachment means for assisting in attaching said holding system to the at least one stud. It also provides such a holding system further comprising: a partitioning means for partitioning the interior of said holding system from the interior of the wall. And it provides such a holding system further comprising: exhaust duct-extension means for providing a bottom extension piece for the exhaust duct, wherein a lower portion of said exhaust duct-extension means is structured and arranged to assist in connecting to the flexible exhaust hose, and wherein the upper portion of said exhaust duct-extension means is structured and arranged to assist in connecting to the exhaust duct. Moreover it provides such a holding system further comprising: exhaust duct-extension means for extending for the exhaust duct; wherein such exhaust duct-extension means comprises; connection means for connecting to the flexible exhaust hose; duct transition means for transitioning the direction of such exhaust duct-extension means; and exterior extension means for extending such exhaust duct-extension means from an interior portion of the wall to at least one point exterior to the wall. Additionally, it provides such a holding system wherein such exterior extension means comprises attachment means for attaching such exterior extension means to at least one portion of the wall. And it provides such a holding system wherein an upper portion of said holding means comprises a grommet means for firmly supporting a gas conduit.

Further, in accordance with a preferred embodiment hereof, this invention provides a holding system located essentially within a wall having at least one stud, for providing for holding at least a portion of a flexible exhaust hose within the wall, comprising, in combination: an exhaust duct-extension means for providing a bottom extension piece for the exhaust duct, wherein, a lower portion of said exhaust duct-extension means is structured and arranged to assist in connecting to the flexible exhaust hose, and an upper portion of said exhaust duct-extension means is structured and arranged to assist in connecting to the exhaust duct; and a holding means for holding said exhaust duct-extension means within the wall.

Even further, in accordance with a preferred embodiment hereof, this invention provides a holding system located essentially within a wall having at least one stud, for providing for holding at least a portion of a gas line and at least a portion of a flexible exhaust hose within the wall, comprising, in combination: a holding means for holding at least a portion of the flexible exhaust hose within the wall; wherein an upper portion of said holding means comprises a grommet means for firmly supporting a gas conduit.

Furthermore, in accordance with a preferred embodiment hereof, this invention provides a holding system located essentially within a wall having at least one stud, for providing for holding at least a portion of a flexible exhaust hose within the wall, comprising, in combination: a guider structured and arranged to smoothly guide at least a portion of the flexible exhaust hose into said holding system; an attacher structured and arranged to assist attaching said holding system to the at least one stud. It also provides such a holding system further comprising: an exhaust duct-extension structured and arranged to provide a bottom extension piece for the exhaust duct, further comprising, a lower portion of said exhaust duct-extension structured and arranged to assist in connecting to the flexible exhaust hose, and an upper portion of said exhaust duct-extension structured and arranged to assist in connecting to the exhaust duct. And it provides such a holding system wherein an upper portion of said holding system comprises a grommet structured and arranged to firmly support a gas conduit. And it provides such a holding system further comprising a connecter structured and arranged to firmly connect said exhaust duct-extension to said holder. And it provides such a holding system wherein said exhaust duct-extension is substantially 4" in diameter.

Further, in accordance with a preferred embodiment hereof, this invention provides a holding system located essentially within a wall having at least one stud, for providing for holding at least a portion of a flexible exhaust hose within the wall, comprising, in combination: an exhaust duct-extension structured and arranged to provide a bottom extension piece for the exhaust duct, further comprising, a lower portion of said exhaust duct-extension structured and arranged to assist in connecting to the flexible exhaust hose, and an upper portion of said exhaust duct-extension structured and arranged to assist in connecting to the exhaust duct; and a holder structured and arranged to hold said exhaust duct-extension within the wall. And it provides such a holding system further comprising at least one attacher structured and arranged to firmly fasten said exhaust duct-extension to said holder. And it further provides such a holding system wherein said at least one attacher comprises at least one rivet.

Further, in accordance with a preferred embodiment hereof, this invention provides a holding system located essentially within a wall having at least one stud, for providing for holding at least a portion of a gas line and at least a portion of a flexible exhaust hose within the wall, comprising, in combination: a holder structured and arranged to hold at least a portion of the flexible exhaust hose within the wall; wherein an upper portion of said holder comprises a grommet structured and arranged to firmly support a gas conduit. And it provides such a holding system wherein said holder comprises a grommet, wherein said grommet comprises elastic material.

DETAILED DESCRIPTION OF A PREFERRED EMBODIMENT OF THE INVENTION

Figure 1:
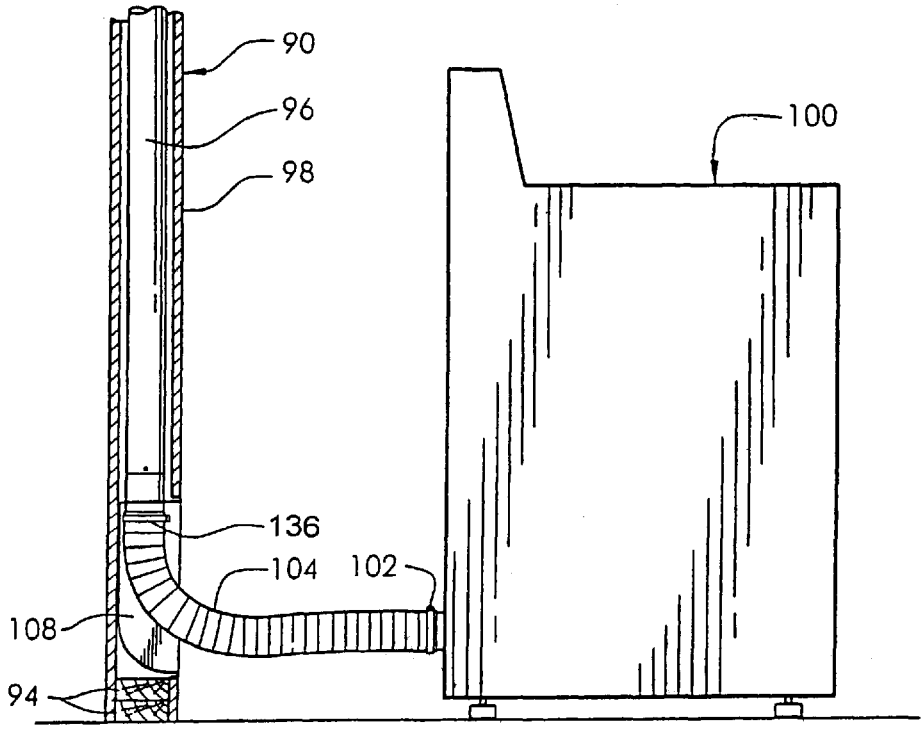
FIG. 1 is a side view of a dryer located at a distance from a wall (shown in cross-section), with a dryer exhaust duct connected to a holding system, according to a preferred embodiment of the present invention, within the wall.

Reference is now made to the drawings. FIG. 1 is a side view of a dryer 100 located at a distance from a wall 90 (shown in cross-section). Dryer exhaust vent 102 is connected to one end of flexible exhaust hose 104, as shown. Other end of flexible exhaust hose 104 is connected to lower duct-extension 106 of the holding system 108 installed within the wall 90, as shown. Upper duct-extension 112 is connected to exhaust duct 96 within wall 90, as shown. Preferably, duct-extension 136 comprises lower duct-extension 106 and upper duct-extension 112, as shown. Preferably, exhaust from the dryer travels first through flexible exhaust hose 104, then through duct-extension 136, and finally into exhaust duct 96, which is preferably vented to the outside.

Figure 2:
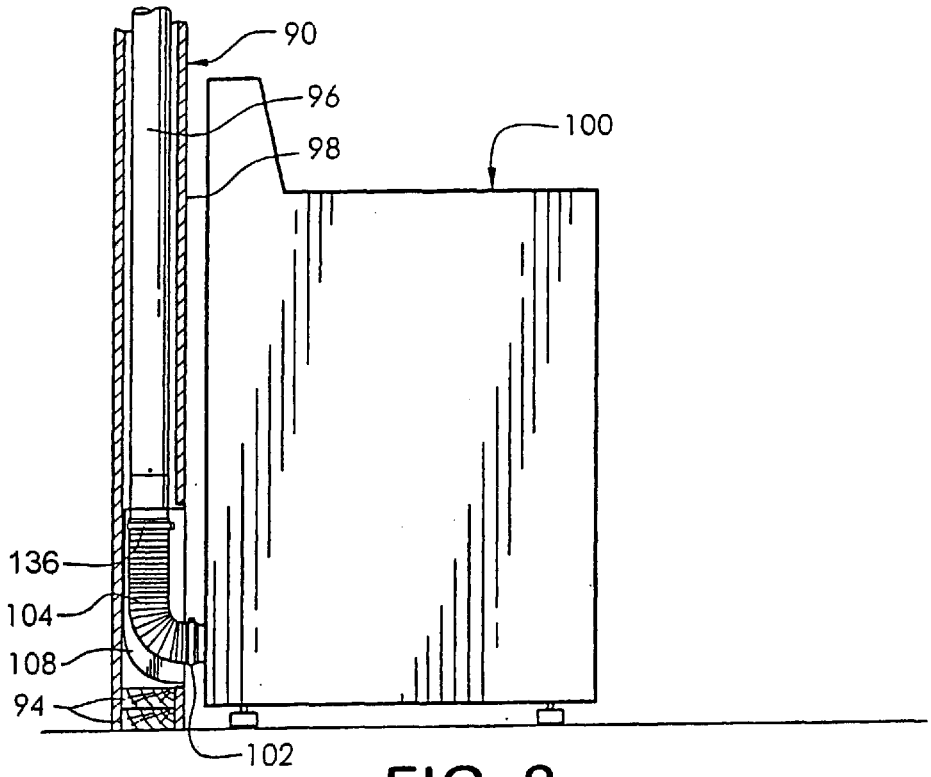
FIG. 2 is a side view of the dryer in close proximity to the wall (shown in cross-section), with the dryer exhaust duct connected to the holding system of FIG. 1 within the wall.

FIG. 2 is a side view of the dryer 100 in close proximity to the typical wall 90 (shown in cross-section). Flexible exhaust hose 104 fits within space in wall provided by holding system 108, allowing dryer 100 to be placed close to wall 90 without crushing, or excessively twisting flexible exhaust hose 104.

Figure 3:
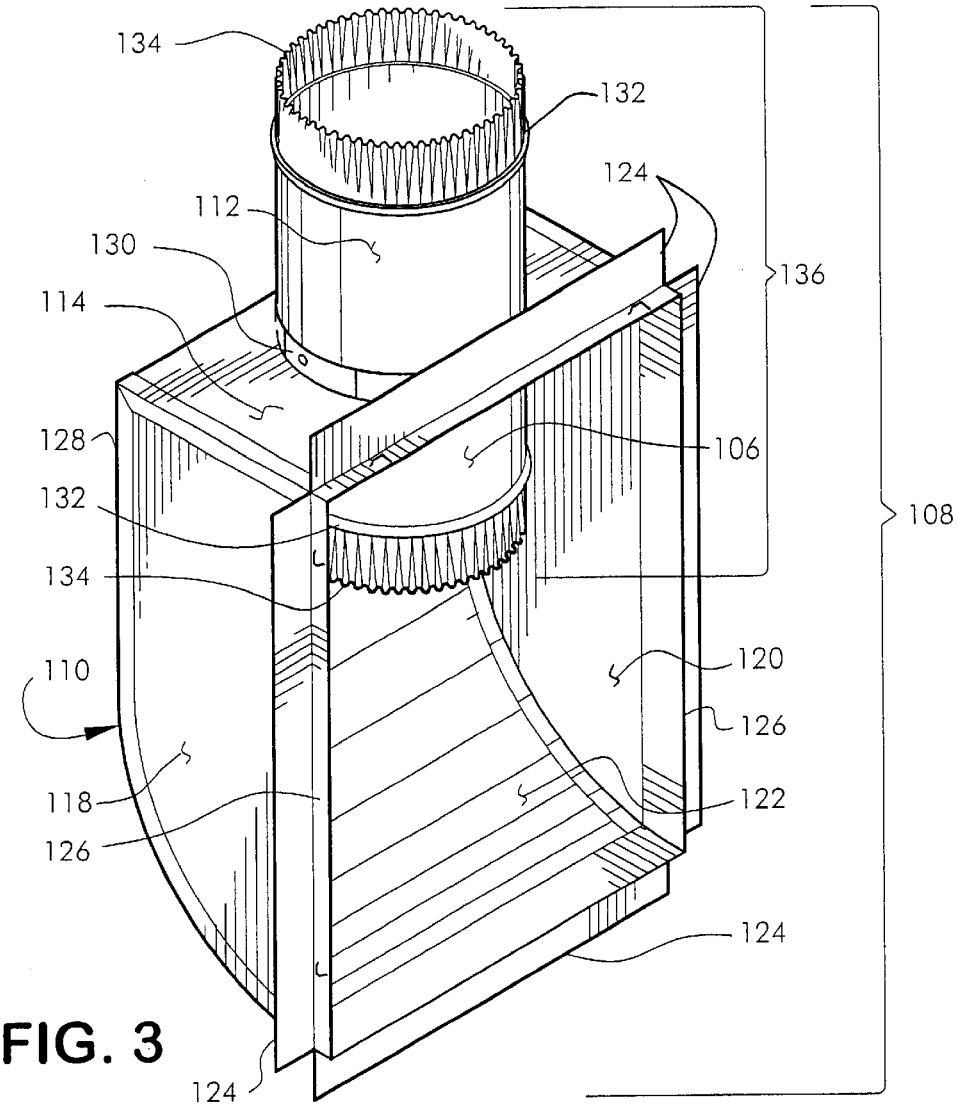
FIG. 3 is a perspective view of the holding system of FIG. 1.
Figure 5:
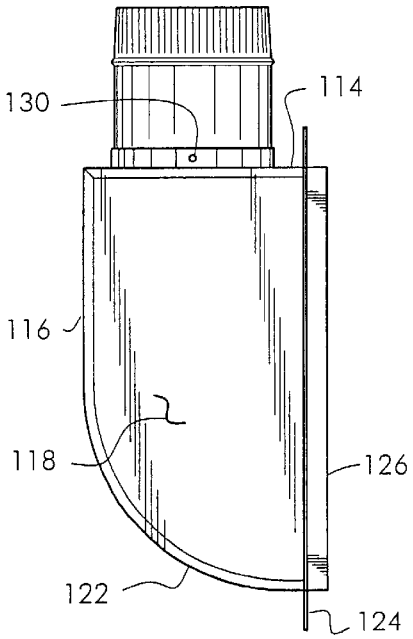
FIG. 5 is a side view of the holding system of FIG. 1.
Figure 6:
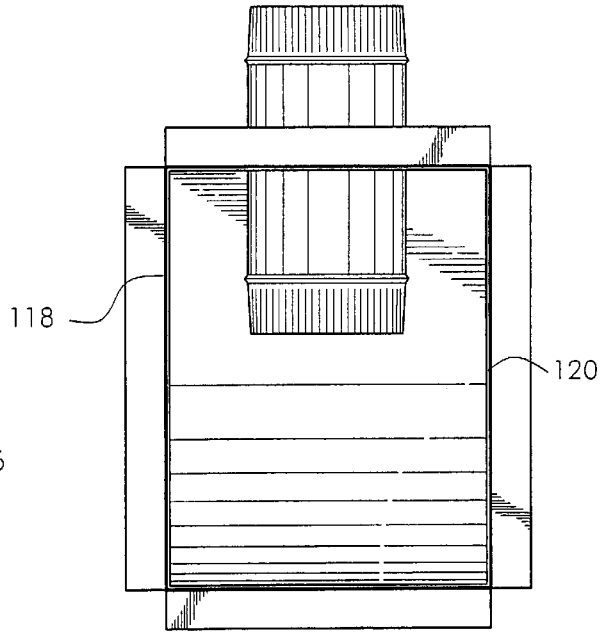
FIG. 6 is a front view of the holding system of FIG. 1.
Figure 7:
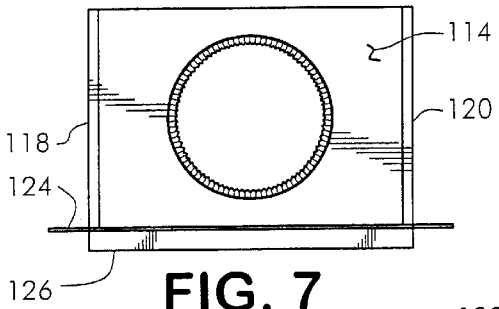
FIG. 7 is a top view of the holding system of FIG. 1.
Figure 8:
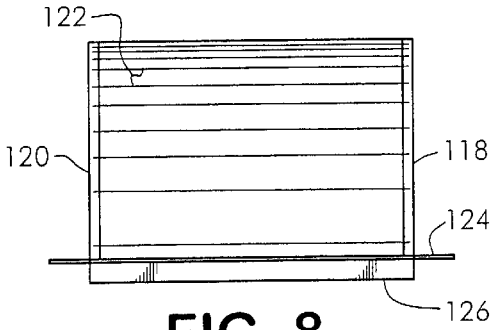
FIG. 8 is a bottom view of the holding system of FIG. 1.
Figure 9:
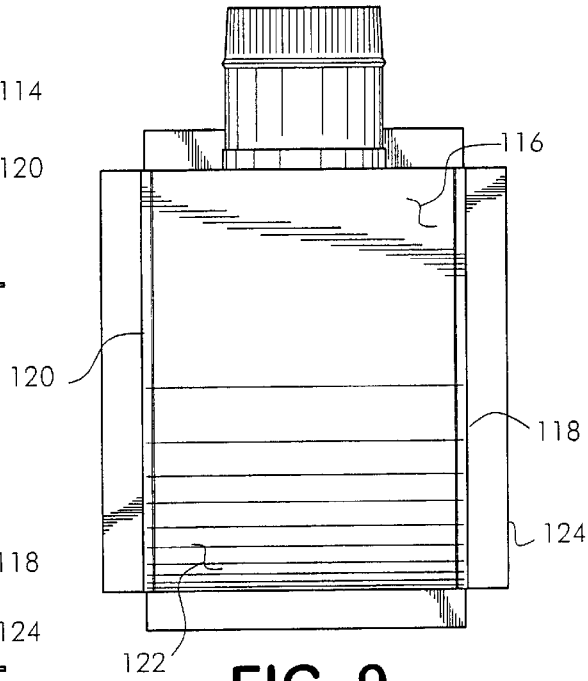
FIG. 9 is a back view of the holding system of FIG. 1.

FIG. 3 is a perspective view, FIG. 5 is a side view, FIG. 6 is a front view, FIG. 7 is a top view, FIG. 8 is a bottom view, and FIG. 9 is a back view, of a holding system according to a preferred embodiment of the present invention. Preferably, holding system 108 comprises receptacle 110 (embodying herein insulating means for insulating the interior of said holding system from the interior of the wall; and embodying herein a holding means for holding exhaust duct-extension means within the wall), and duct-extension 136 (embodying herein an exhaust duct-extension means for providing a bottom extension piece for the exhaust duct, wherein a lower portion of said exhaust duct-extension means connects with the flexible exhaust hose, and an upper portion of said exhaust duct-extension means connects with the exhaust duct).

In the preferred embodiment the width of receptacle 110, defined by the distance between left side surface 118 and right side surface 120, is about 14", which corresponds to spacing between stud(s) 94 in wall 90; however, under appropriate circumstances, other receptacle widths may suffice.

The height of receptacle 110, defined by the distance between the top surface 114 and guiding surface 122 at the front of receptacle 110, is about 11"; however, under appropriate circumstances, other receptacle heights may suffice. Preferably, guiding surface 122 (embodying herein a guiding means for smoothly guiding at least a portion of the flexible exhaust hose into said holding system; and embodying herein a guider structured and arranged to smoothly guide at least a portion of the flexible exhaust hose into said holding system) is curved and/or sloped obliquely upwards from front to back, as shown. When flexible exhaust hose 104 is compressed into holding system 108 (as when dryer 100 is being moved closer to wall 90), the guiding surface 122 guides the flexible exhaust hose 104, helping to prevent the flexible exhaust hose 104 from kinking.

Preferably, receptacle 110 has a flange 124 (embodying herein attachment means for assisting in attaching said holding system to the at least one stud) that extends perpendicular to the side walls of receptacle 110. The length that flange 124 extends is about 1"; however, under appropriate circumstances, other arrangements may suffice. Preferably, the depth of receptacle 110, defined by the distance between flange 124 and back surface 116 of receptacle 110, is about 4.75", which allows receptacle to fit within typical wall 90; however, under appropriate circumstances, other depths may suffice. Preferably, receptacle 110 has projection 126 that extends forward from flange 124 of receptacle 110, as shown. Preferably, the length of the projection is about ½", which corresponds to thickness of drywall 98 in wall 90; however, under appropriate circumstances, other projection lengths may suffice.

Preferably, receptacle 110 is made of metal, preferably sheet metal, preferably galvanized steel; however, under appropriate circumstances, other materials may suffice. Preferably, top surface 114, back surface 116, and guiding surface 122 are made of a single piece that has been folded and bent to the desired shape, to which left side surface 118, and right side surface 120, are joined by seam(s) 128; however under appropriate circumstances, other arrangements may suffice. Preferably, seam(s) 128 are made by folding and crimping; however, under appropriate circumstances, other arrangements may suffice. Preferably, projection 126 and flange 124 are constructed by folding, as shown; however, under appropriate circumstances, other arrangements may suffice. Preferably, in construction of holding system 108, duct-extension 136 is inserted through an opening in receptacle 110 and attached with one or more attacher(s) 130, as shown. Preferably, attacher(s) 130 are rivets; however, under appropriate circumstances, other arrangements may suffice. Preferably, there is a close fit between the duct-extension 136 and the receptacle 110, for insulation, pest control and aesthetic reasons.

Preferably, duct 112 is made of metal, preferably sheet metal, preferably galvanized steel; however, under appropriate circumstances, other materials may suffice. Preferably, lower duct-extension 106 comprises duct-narrowing corrugations 134 and duct-expansion ring 132. Preferably, duct-narrowing corrugations 134 allow flexible exhaust hose 104 to snugly fit over a portion of lower duct-extension 106, and duct-expansion ring 132 helps in achieving a snug fit. To assist in connection, the flexible exhaust hose 104 is slipped over the duct-narrowing corrugations 134 and duct-expansion ring 132 of the lower duct-extension 106.

Preferably, upper duct-extension 112 comprises duct-narrowing corrugations 134 and duct-expansion ring 132. To assist in connection, duct-narrowing corrugations 134 allow upper duct-extension 112 to be inserted into exhaust duct 96. Duct-expansion ring 132 on the upper duct-extension 112 assists in providing a snug connection to the exhaust duct 96.

If the holding system 108 is to be used in conjunction with a dryer 100 which is powered by electricity, duct 112 is preferably located substantially centered between the left side surface 118 and the right side surface 120; however, under appropriate circumstances, other configurations may suffice.

Figure 4:
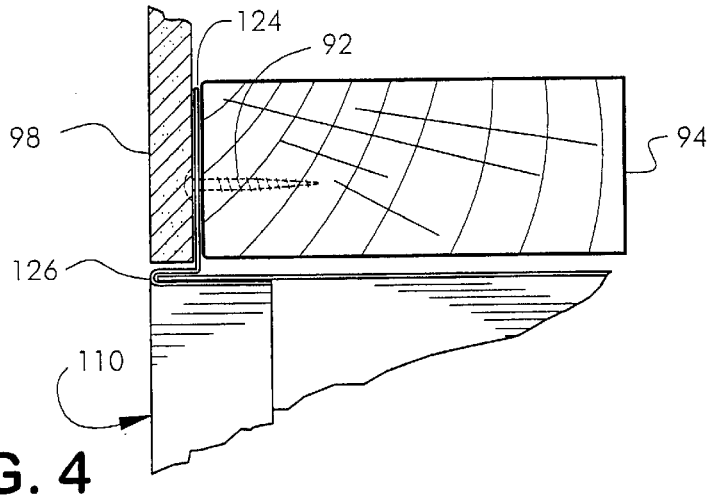
FIG. 4 is a close-up view of a portion of the holding system of FIG. 1 installed within a wall.

FIG. 4 is a close-up view of a portion of holding system 108 installed within wall 90. Preferably, flange 124 of the holding system 108 is positioned over stud(s) 94 in wall 90, as shown. Preferably, one or more fastener(s) 92 attach flange 124 to stud(s) 94, as shown. Preferably, drywall 98 is installed over flange 124 and abutting projection 126, as shown. Preferably, outer surface of drywall 98 is flush with front edge of projection 126, as shown.

Referring to FIG. 2 and FIG. 4, the holding system 108 may be installed when wall 90 is initially constructed, or may also be installed if wall 90 is already completed. In the latter case, a portion of drywall 98 is removed where the holding system 108 is to be installed, preferably, at a location adjacent and between stud(s) 94 and other studs within wall 90. A portion of the existing exhaust duct 96 is removed, and the upper duct-extension 112 of the holding system 108 is attached to the exhaust duct 96. Preferably, fastener(s) 92, are used in conjunction with flange 124 to firmly attach holding system 108 to at least one stud(s) 94 with wall 90, as shown. Preferably, the fastener(s) 92 comprise nails or screws. Preferably, holding system 108 is attached to and between two stud(s) 94. Preferably, the drywall 98 is then installed and fitted around holding system 108, abutting the projection 126, as shown. Preferably, the holding system 108 is installed at a height substantially equal to the height of the dryer exhaust vent 102.

Figure 10:
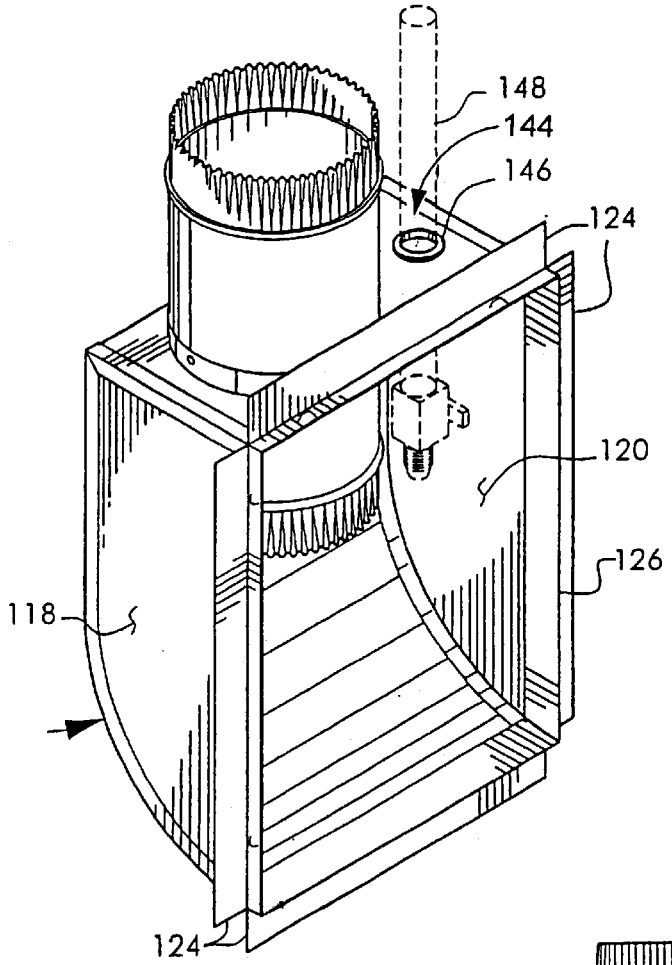
FIG. 10 is a perspective view of another preferred embodiment of a holding system.
Figure 11:
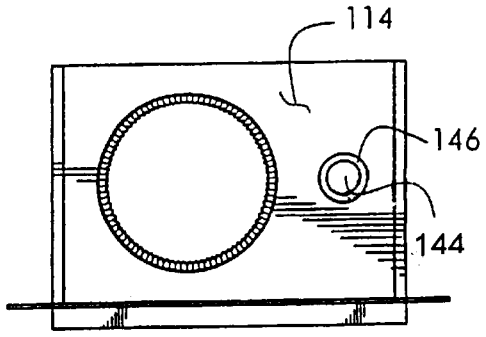
FIG. 11 is a top view of the holding system of FIG. 10.
Figure 12:
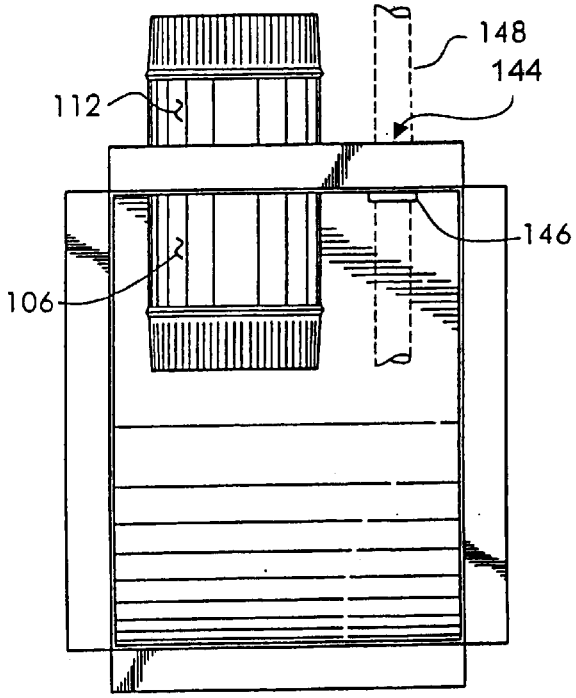
FIG. 12 is a front view of a holding system of FIG. 10.

FIG. 10 is a perspective view, FIG. 11 is a top view, and FIG. 12 is a front view, of another preferred embodiment of a holding system for use with a dryer, which is powered by natural gas. If the holding system 108 is to be used with a gas dryer, it is preferable to recess both exhaust vent and gas conduit 148, duct 112 is therefore preferably located wherein centerline of duct 112 is substantially 5" from right side surface 120, and centerline of conduit opening 144 is located substantially 3" from left side surface 118, as shown. Preferably, conduit opening 144 comprises a grommet 146 (embodying herein wherein an upper portion of said holding means comprises a grommet means for firmly supporting a dryer gas conduit 148). Preferably, grommet comprises elastic material.

Figure 14:
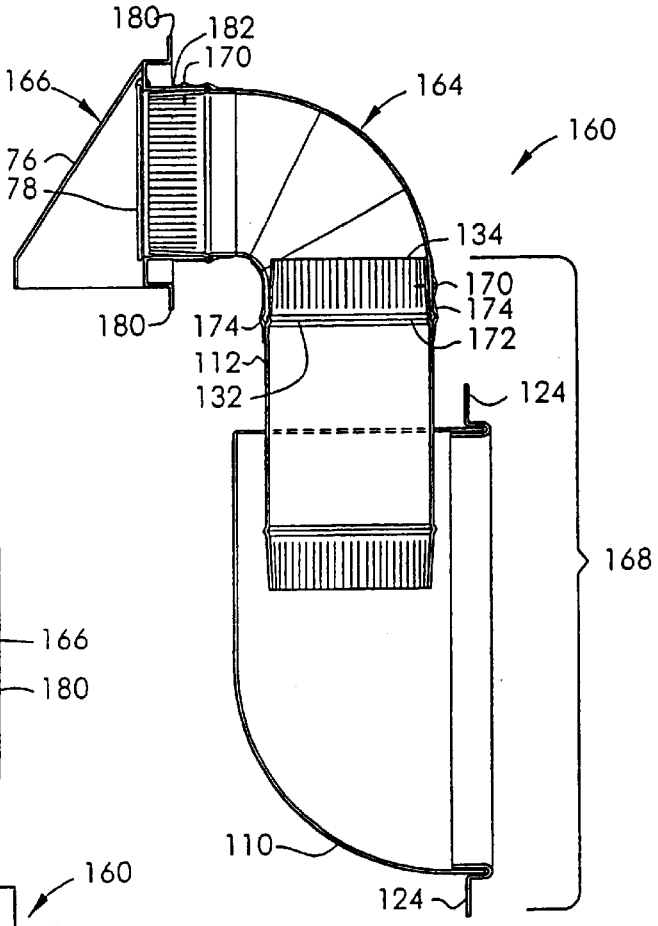
FIG. 14 is the sectional view 14—14 of FIG. 13 illustrating the exterior wall holding system.
Figure 13:
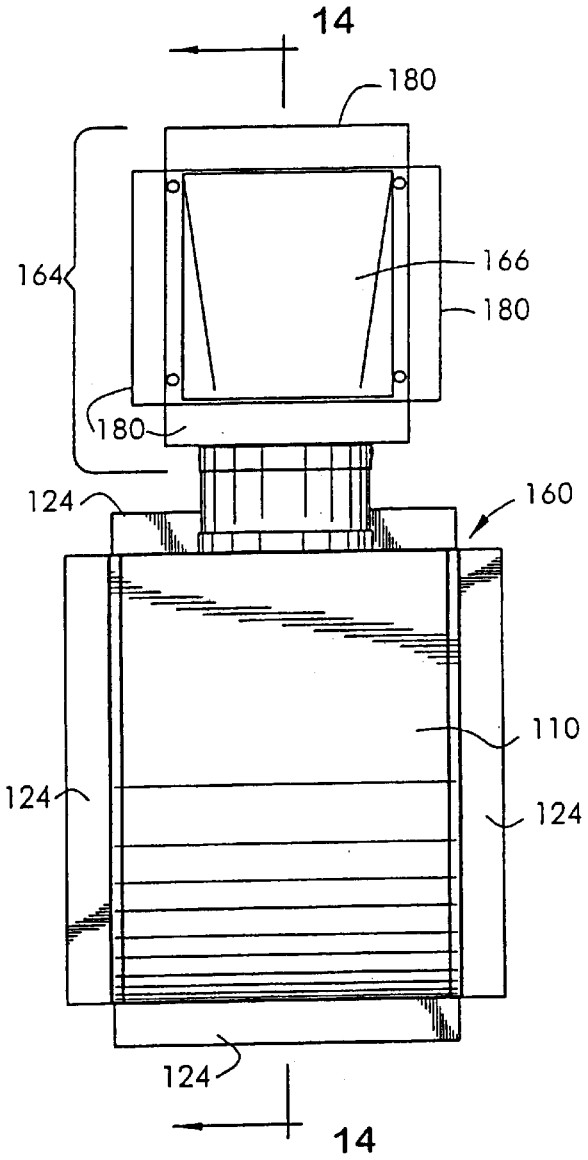
FIG. 13 is a rear view of an exterior wall holding system of another preferred embodiment of the present invention.
Figure 15:
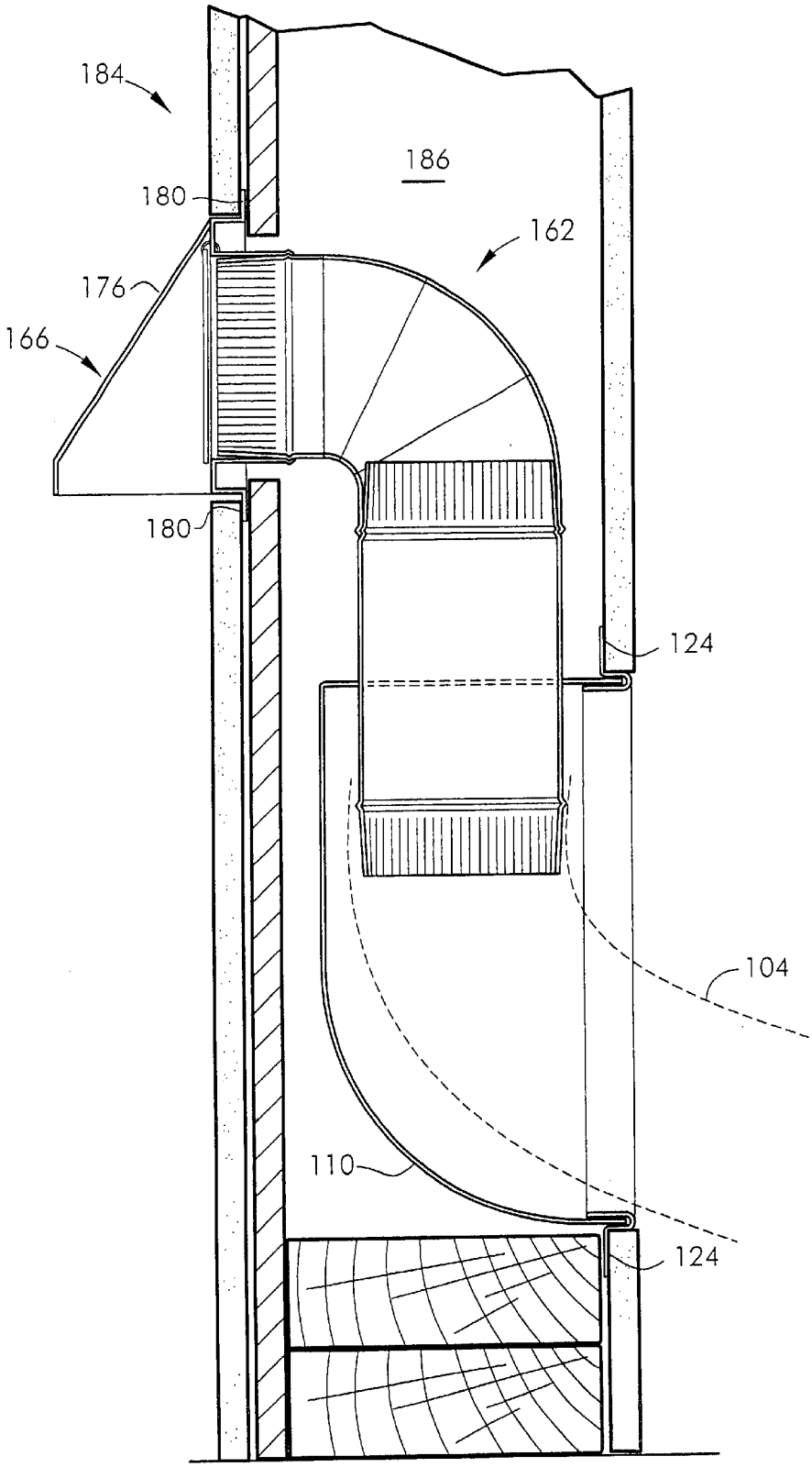
FIG. 15 is the sectional view 14—14 of FIG. 13 illustrating the exterior wall holding system positioned within an exterior wall.

FIG. 13 is a rear view of exterior wall holding system 160 according to another preferred embodiment of the present invention. In many building structures, the wall adjacent the dryer falls along the exterior of the building. In the embodiments of FIG. 13, FIG. 14 and FIG. 15, holding system includes through-the-wall extension 162 (herein embodying duct transition means for transitioning the direction of such exhaust duct-extension means and further herein embodying exterior extension means for extending such exhaust duct-extension means from an interior portion of the wall to at least one point exterior to the wall) consisting of an attachable elbow vent duct 164 and attachable vent hood 166, as shown. Through-the-wall extension 162 preferably provides a means for direct venting the dryer exhaust to the exterior of the building structure.

FIG. 14 is the sectional view 14—14 of FIG. 13 illustrating exterior wall holding system 160. As illustrated in FIG. 14, the base assembly 168 of exterior wall holding system 160 is preferably similar in design and construction to holding system 108 of the prior embodiments. Preferably, elbow vent duct 164 is of matching diameter to upper duct-extension 112 and preferably forms an adjustable sweep having a transition sweep of about ninety degrees, as shown. An end of elbow vent duct 164 is preferably adapted to slip over duct-narrowing corrugations 134 and is firmly joined to upper duct-extension 112 by the frictional interlocking of the two assemblies along duct-expansion ring 132, as shown. Under appropriate circumstances, such as conditions of heavy service, one or more self-drilling, self-tapping sheet metal screws 170 may be applied to secure joint 172 against movement, as shown. Similarly, under appropriate circumstances, adhesive "duct" tape 174 may be circumferentially applied to the exterior surfaces of joint 172 to further strengthen and seal the connection, as shown. Preferably, vent hood 166 is attached to duct-narrowing corrugations 134 of elbow vent duct 164 and is preferably secured to elbow vent duct 164 using the preferred methods described above. Preferably, vent hood 166 consists of a rain protective hood 176, a hinged damper 178, a mounting flange 180 and a duct-receiving portion 182, as shown. While it is preferred that both vent hood 166 and elbow vent duct 164 be formed as independent sections, under appropriate circumstances, such as to simplify installation, both may be combined as a single assembly. Under appropriate circumstances, vent hood 166 may include other accessories such as protective insect and rodent screens.

FIG. 15 is the sectional view 14—14 of FIG. 13 illustrating exterior wall holding system 160 positioned within exterior wall 184. Preferably, exterior wall holding system 160 (as with prior embodiments) fits within wall cavity 186, as shown. Preferably, receptacle 110 of the exterior wall holding system 160 has a flange 124 (embodying herein attachment means for assisting in attaching said holding system to the at least one stud) that extends perpendicular to the sidewalls of receptacle 110, as shown. Vent hood 166 of through-the-wall extension 162 is mounted to the surrounding structure of exterior wall 184, as shown. Mounting flange 180 (herein embodying attachment means for attaching such exterior extension means to at least one portion of the wall) of vent hood 166 is adapted to receive a plaster or composite finish, such as EFIS; however, under appropriate circumstances, mounting flange 180 may be adapted to accommodate other finishes having varying thickness and compositions. Preferably, through-the-wall extension 162 is sized to fit within walls having standard construction and thickness; however, under appropriate circumstances, additional accessories, such as duct-extension segments, may be placed between elbow vent duct 164 and vent hood 166 to accommodate unusually thick wall construction.

Although applicant has described applicant's preferred embodiments of this invention, it will be understood that the broadest scope of this invention includes such modifications as diverse shapes and sizes and materials. Such scope is limited only by the below claim as read in connection with the above specification.

What is claimed is:

1. A recessed dryer rough-in box recessable in a wall, for installing a clothes dryer with flexible exhaust hose in close proximity to a wall, comprising:

a first side surface including an upper portion having a first side width, and a bottom portion including a downwardly disposed arch;

a second side surface including an upper portion having a second side width substantially equal to said first side width, and a bottom portion including a downwardly disposed arch, wherein a portion of said first side surface is substantially parallel to a portion of said second side surface, and wherein said first side arch and said second side arch have substantially the same radian;

a top surface having a width substantially equal to the width of said first and second side surfaces, said top surface including a top surface length, said top surface further including a first aperture for including a duct extension, and a second aperture including a grommet; and a substantially arched guiding surface for smoothly guiding a portion of said flexible hose recoiling toward said top surface when moving said flexible hose in proximity to said wall, said guiding surface in communication with said top surface length, said first side arch, and said second side arch, such that said guiding surface is downwardly arched with substantially the same radian as said first side arch and said second side arch.

2. A recessed dryer rough-in box according to claim 1, further including a duct extension interposed in said first top surface aperture, for connecting to said dryer hose at a first end and to an exhaust duct.

3. A recessed dryer rough-in box according to claim 1, wherein said grommet is configured to snuggly and securely support a conduit.

4. A recessed dryer rough-in box according to claim 1, wherein said grommet comprises an elastic material.

5. A recessed dryer rough-in box according to claim 1 wherein said guiding surface is comprised of sheet metal.

6. A recessed dryer rough-in box according to claim 1 wherein said guiding surface is comprised of galvanized steel.

7. A recessed dryer rough-in box according to claim 1, wherein said guiding surface is comprised of a single piece of folded metal.

8. A recessed dryer rough-in box according to claim 1, wherein said first side surface, said second side surface, said top surface and said guiding surface are immovably installed in the wall.

9. A recessed dryer rough-in box according to claim 2, further comprising a through-the-wall extension connected to said exhaust duct, for exhausting said dryer through the wall.

10. A system for a recessed dryer rough-in box recessable in a wall, for installing the clothes dryer with flexible exhaust hose in close proximity to a wall, comprising:

an exhaust system recessed in the wall, the exhaust system comprising a downwardly arched guiding surface for guiding said flexible hose in an upwardly direction when compressed; and a grommet for securely supporting a conduit.

11. A system according to claim 10, wherein said grommet is comprised of elastic material.

12. A system according to claim 10, wherein said guiding surface is configured to support said flexible hose.

13. A system according to claim 10, wherein said guiding surface is formed of a single sheet of metal.

14. A system according to claim 10, wherein said guiding surface is comprised of galvanized steel.

15. A system according to claim 10, wherein said exhaust system is immovably installed in the wall.

16. A method for exhausting a clothes dryer positioned in proximity to a wall, the dryer having a flexible exhaust hose, the method comprising the steps of:

providing a recessed dryer rough-in box including, an exhaust extension for connecting to the flexible exhaust hose, an arched guiding surface for smoothly guiding said flexible exhaust hose when compressed, and a grommet for securely supporting a conduit.

* * * * *